US006907759B2

(12) United States Patent
Sciacca

(10) Patent No.: US 6,907,759 B2
(45) Date of Patent: Jun. 21, 2005

(54) METHOD FOR PRODUCING TUBULAR KNITWEAR ITEMS AND PRODUCTS OBTAINED THEREBY

(76) Inventor: Franco Sciacca, Via Veneto, 18, 22070 Cassina Rizzardi (IT)

( * ) Notice: Subject to any disclaimer, the term of this patent is extended or adjusted under 35 U.S.C. 154(b) by 55 days.

(21) Appl. No.: 10/275,132

(22) PCT Filed: Apr. 26, 2001

(86) PCT No.: PCT/IT01/00202

§ 371 (c)(1),
(2), (4) Date: Jun. 10, 2003

(87) PCT Pub. No.: WO01/83865

PCT Pub. Date: Nov. 8, 2001

(65) Prior Publication Data

US 2004/0011085 A1 Jan. 22, 2004

(30) Foreign Application Priority Data

May 2, 2000 (IT) ..... CO2000A0012

(51) Int. Cl.[7] ..... D04B 1/22
(52) U.S. Cl. ..... 66/171
(58) Field of Search ..... 66/171, 172 E, 66/176, 177, 194, 175, 189, 8, 215, 170

(56) References Cited

U.S. PATENT DOCUMENTS 1,428,939 A * 9/1922 Bosworth ..... 66/174
4,059,973 A * 11/1977 Gresillon ..... 66/177
4,682,479 A * 7/1987 Pernick ..... 66/176
5,836,179 A * 11/1998 van Laar ..... 66/171
6,164,094 A * 12/2000 Lonati et al. ..... 66/172 R
6,272,888 B1 * 8/2001 Fujita et al. ..... 66/172 E

* cited by examiner

*Primary Examiner*—Danny Worrell
(74) *Attorney, Agent, or Firm*—James B. Conte; Barnes & Thornburg LLP

(57) ABSTRACT

The invention relates to tubular knitwear item provided with suitable openings (H) or holes automatically obtained for shoulder straps, neck portions, belts, strings, stripes, knots, loops and the like, i.e. for various applications and purposes, such as anatomic support, and for aesthetic and functional connections also with other manufactured items. The invention co-ordinates the suitable needle selection according to the jacquard design and to the work cycle of the knitting machine and enable, for definite fabric areas and needles (A), the temporary stop of the knitting process and the subsequent stitch discharge, followed by the production of new fabric stitches, also with needle discard and floating yarns (FF) so as to obtain transparent effects and the production of fringes.

24 Claims, 5 Drawing Sheets

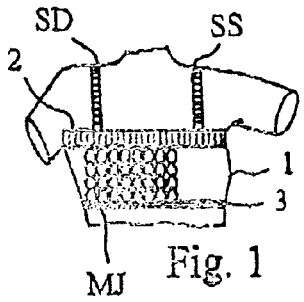
Fig. 1
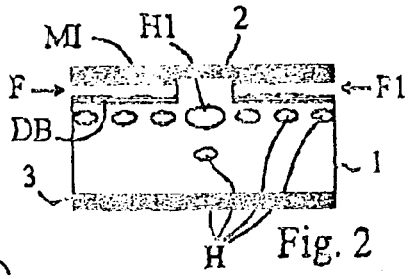
Fig. 2
Fig. 4
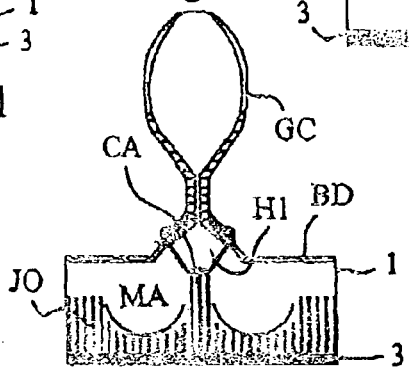
Fig. 5
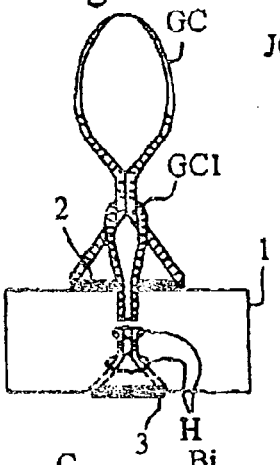
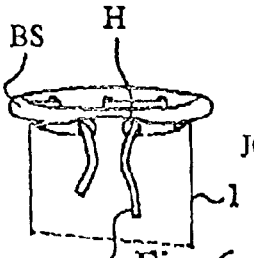
Fig. 6
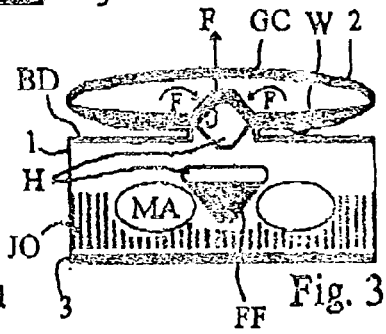
Fig. 3
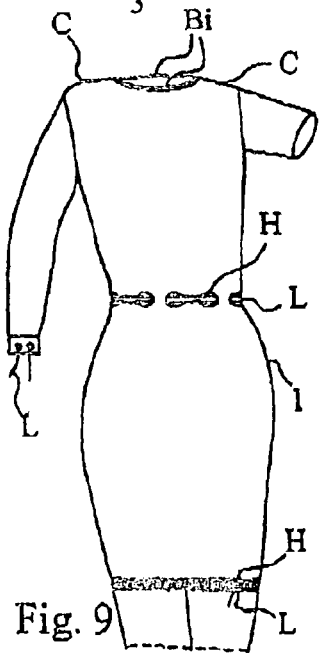
Fig. 9
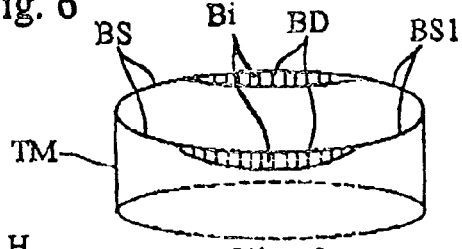
Fig. 8
Fig. 7
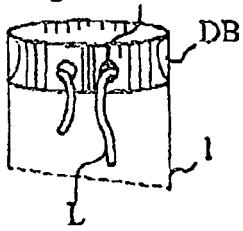
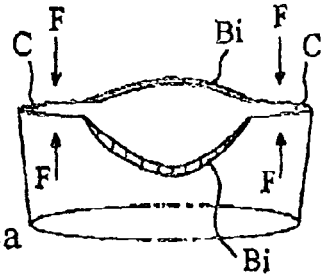
Fig. 8a

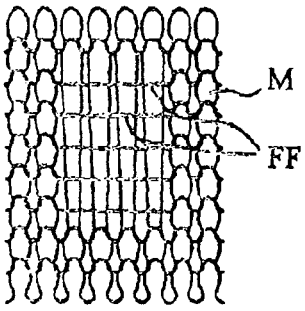
Fig. 10
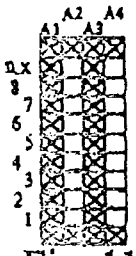
Fig. 11
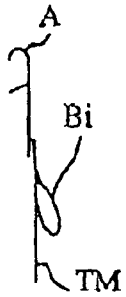
Fig. 12a
Fig. 12
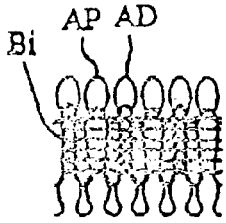
Fig. 10a
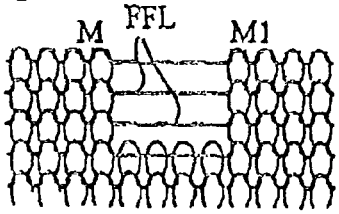
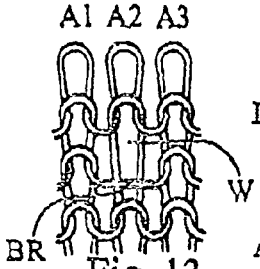
Fig. 13
Fig. 14
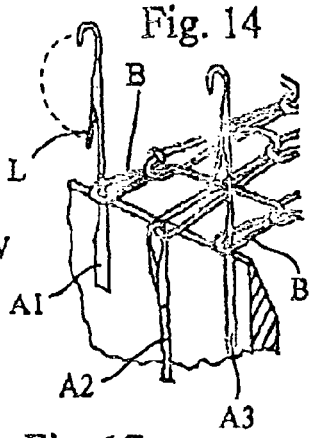
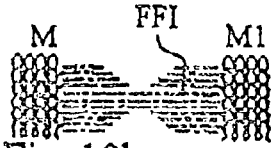
Fig. 10b
Fig. 15
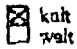
Fig. 17
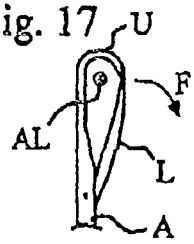
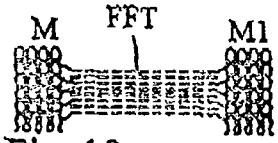
Fig. 10c
Fig. 16
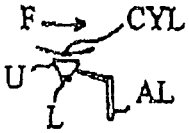
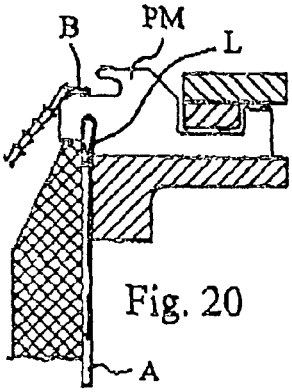
Fig. 20
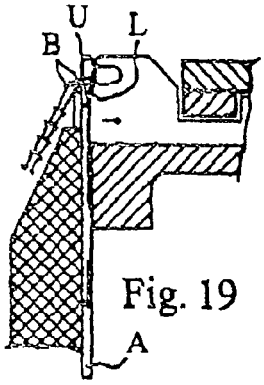
Fig. 19
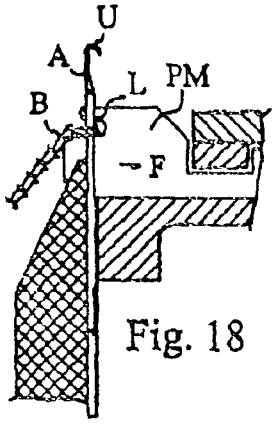
Fig. 18

Fig. 21
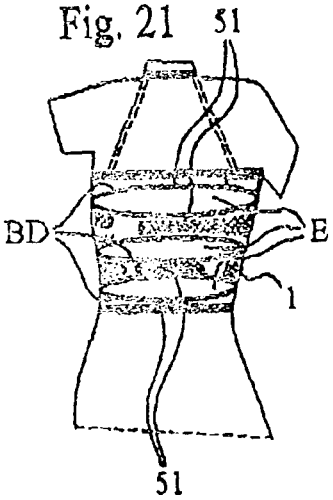
Fig. 22
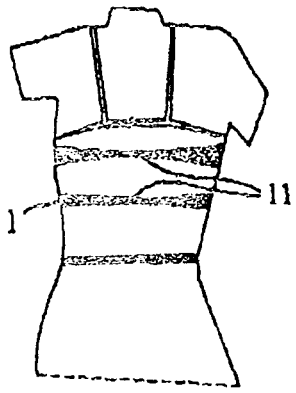
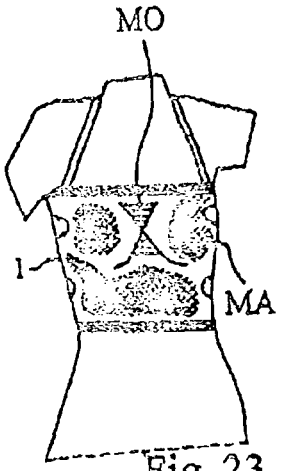
Fig. 23
Fig. 24
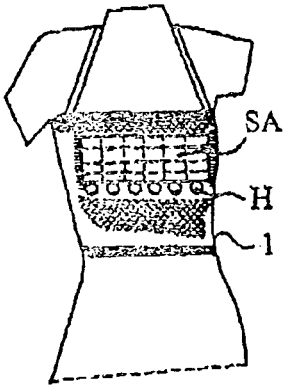
Fig. 25
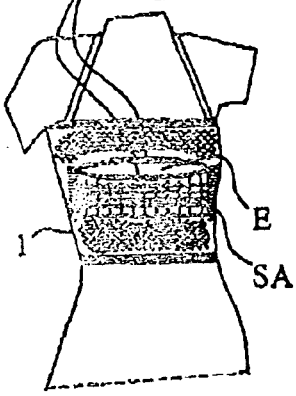
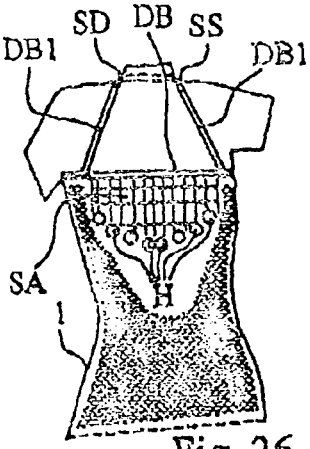
Fig. 26
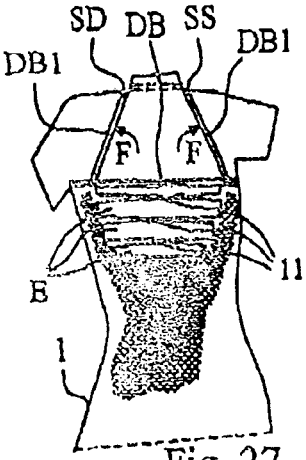
Fig. 27
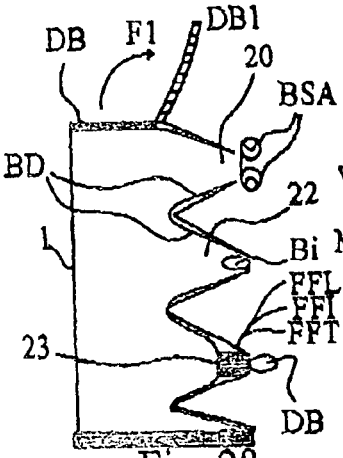
Fig. 28
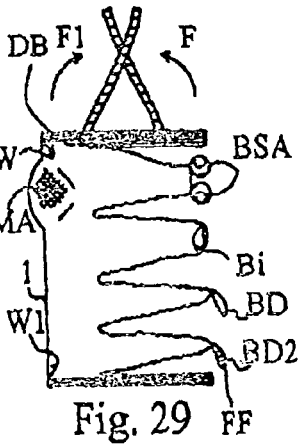
Fig. 29

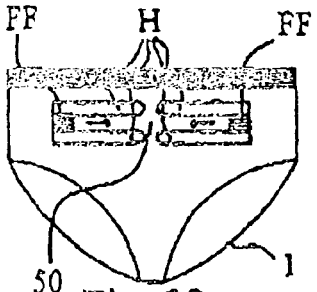
Fig. 38
Fig. 38a
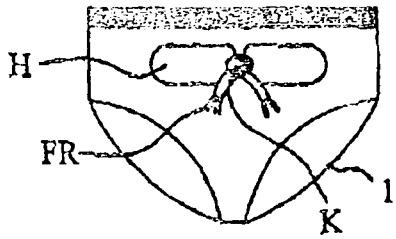
Fig. 38b
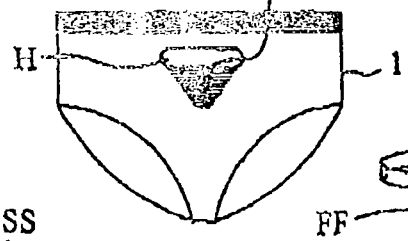
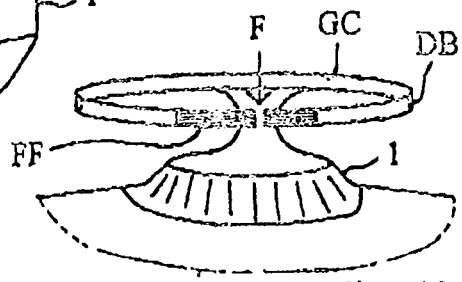
Fig. 40
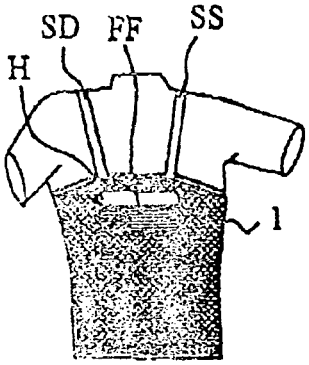
Fig. 39
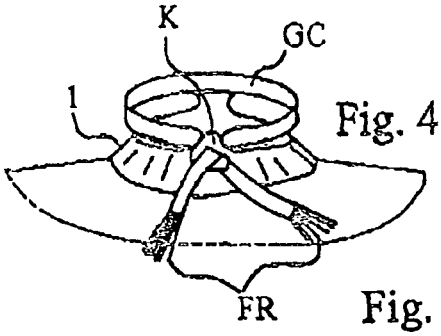
Fig. 40a
Fig. 42
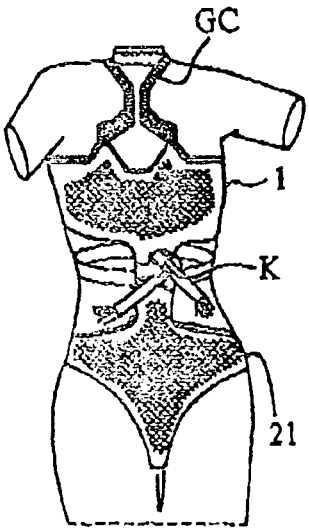
Fig. 43
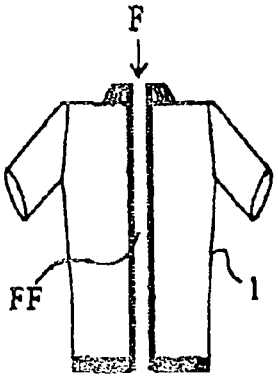
Fig. 41
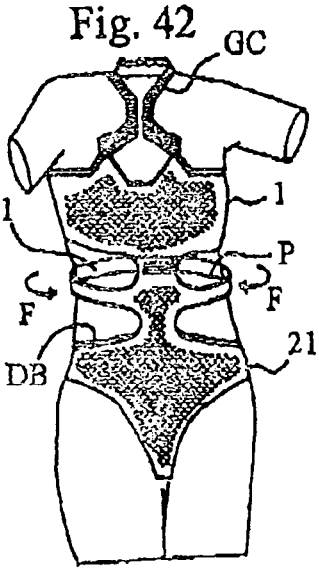

METHOD FOR PRODUCING TUBULAR KNITWEAR ITEMS AND PRODUCTS OBTAINED THEREBY

TECHNICAL FIELD

The introduction of "full electronic" circular knitting machines with differentiated diameters has attracted the knitting industry's interest since their versatility allows to produce a wide range of tubular items, such as for instance bras, brassieres, pants, dresses, trousers, "fuseaux" (tight trousers), skirts, teddies, swimsuits, technical items and more. But due to some inherent technical and textile limitations, such as for instance the lack of shoulder straps, belts, loops, strings, ribbons and various openings, most of the aforementioned knitwear items systematically require laborious and expensive additional finishing operations such as cutting and sewing, with the subsequent fabric scraps which affect production costs extensively and permanently. As is generally known, Italian patent no. 1288310 provides for various embodiments concerning the production of shoulder straps, loops or braces, or various openings for legs and arms; these solutions, however, show technical difficulties and additional costs due to the complex mechanisms involving fabric pick-up and transport from one side of the needle cylinder to the other side.

AIMS OF THE PRESENT INVENTION

The present invention aims at reducing to a significant extent or at wholly eliminating the aforesaid technical and productive limitations, so as to automatically obtain semi-finished or finished tubular knitwear items, i.e. provided with shoulder straps, rings, holes, loops, ribbons and fabric stripes with original productive, technical, aesthetic and commercial purposes.

All this stated, a main aim of the present invention consists in providing a method for producing tubular items, also shaped or fitted, provided with one or more holes or openings, also quite wide, in a single or double-layer knitted fabric (1), said items being automatically produced by the suitable selection and presence of the elements directly or indirectly involved in the knitting process, such as for instance jacks, needles, under-needles and sinkers.

A further aim consists in providing said tubular items with one or more shoulder straps, automatically produced by the suitable selection and presence of the aforesaid elements directly or indirectly involved in the knitting process.

An additional aim consists in providing a method and apparatus for producing said tubular items provided with at least a fabric half-ring, preferably introduced into one or more holes of said item and used for the aesthetic and functional connection with a separate item.

Another aim consists in providing a method and apparatus for producing items provided with one or more separate loops or fabric stripes, which are connected to the knitted tube only on their ends, also with their floating yarns only, the latter being automatically produced by the suitable presence or absence of needles.

A further aim consists in providing said tubular items with one or more zones of lighter and more transparent fabric automatically produced by the suitable selection and presence of the elements directly or indirectly involved in the knitting process. Further aims will be evident from the description, examples and accompanying drawings, per se or in combination, beyond the final claims.

DISCLOSURE OF THE INVENTION

The above mentioned aims are substantially achieved by a method for producing tubular knitwear items by discharging and taking up single stitches following a given pattern, also with needle discard and floating yarns, and products obtained thereby, according to the appended claims.

The characteristics of the invention and the advantages resulting thereof will be more evident from the following non limiting description of embodiments provided by way of example, which can be advantageously applied to most circular knitting machines.

BRIEF DESCRIPTION OF THE DRAWINGS

The description will be made with reference to the accompanying drawings in which:

FIG. 1 shows a brassiere produced according to the prior art;

FIG. 2 shows a knitted item produced according to the present invention;

FIGS. 3 and 4 show the evolution of a knitted tube gradually taking on the appearance and functions of a brassiere provided with holes H, shoulder straps, neck portion GC and floating yarns FF produced according to the invention;

FIG. 5 shows another embodiment of a brassiere;

FIG. 6 shows a portion of knitted tube provided with holes H necessary for the introduction and use of a string L;

FIG. 7 shows a portion of knitted tube similar to the portion in FIG. 6, provided with a double welt;

FIGS. 8 and 8*a* show two steps of the production of a collar with two-layer welts DB obtained from an initial knitted tube TM;

FIG. 9 shows a dress provided with a collar and a lace L inserted in openings H;

FIG. 10 shows a fabric with a central zone having floating yarns FF;

FIGS. 10*a*, 10*b* and 10*c* graphically show a jersey fabric interrupted by different applications of floating yarns FF, variously manipulated and knitted;

FIG. 11 technically show the mechanical-textile diagrams, i.e. the sequences to be followed in the production of the three-dimensional knit frills Bi;

FIG. 12 is a front view of a fabric having frills Bi made only with odd needles AD, with even needles AP not operating;

FIG. 12*a* shows a needle A, usually housed within a bed or cylinder, on whose stem the underlying fabric and the inner frill Bi are still engaged;

FIG. 13 shows a missing stitch W and a single "bridle" BR within a knitted structure;

FIG. 14 is a perspective view of needles starting the sequences for the production of knit frills Bi, by weaving a single "bridle";

FIG. 15 is a technical key for the pattern of FIG. 11;

FIG. 16 is a plan view of a portion of cylinder CYL with the hook U of a needle and an adjacent latch-opening device AL;

FIG. 17 is a side view of a needle A and a latch-opening device AL;

FIGS. 18, 19 and 20 are a sequence of lateral views of needles A and sinkers PM during the discharge of the last fabric stitches B;

FIG. 21 shows the rear portion of a knitted item with fabric stripes 51 alternated with broad empty zones;

FIG. 22 shows another embodiment of the item of FIG. 21, with thinner fabric zones 11 alternated with empty zones;

FIG. 23 shows the front portion of a manufactured item with a central zone of various mesh knitted stitches;

FIGS. 24 and 25 are front views of two different embodiments of a manufactured item provided with a lighter fabric zone SA;

FIG. 26 shows a dress provided with holes H and a lighter fabric zone SA;

FIG. 27 is a front view of a dress with fabric stripes 11 alternated with broad empty zones, FIGS. 28 and 29 are sectioned lateral schematic views of two manufactured items 1 provided with a usual front portion and a back portion with fabric stripes alternated to empty zones;

FIG. 38 shows a panty provided with wide openings H which form a fabric stripe 50 with two ends provided with floating yarns FF;

FIG. 38*a* shows the item of FIG. 38 with the floating yarns which have been cut and the edges of the stripe joined with a knot K;

FIG. 38*b* shows a panty with decreasing floating yarns FF and an opening H.

FIG. 39 shows another knitted item provided with an opening and adjacent floating yarns;

FIG. 40 shows a knitted item with a neck portion GC having a zone FF with floating yarns;

FIG. 40*a* shows the item of FIG. 40 in which the floating yarns have bean cut and the neck portion has been knotted;

FIG. 41 shows a knitted item with a central opening obtained by a plurality of floating yarns which have been cut;

FIG. 42 shows a tubular knitwear item consisting of an upper and lower portion 1 and 21 partially joined by a knitted belt P-P1 placed on the hips;

FIG. 43 shows the item of FIG. 42 with the edges of the knitted belt which have been cut and knotted.

DESCRIPTION OF THE ILLUSTRATIVE EMBODIMENTS

Figure 30:
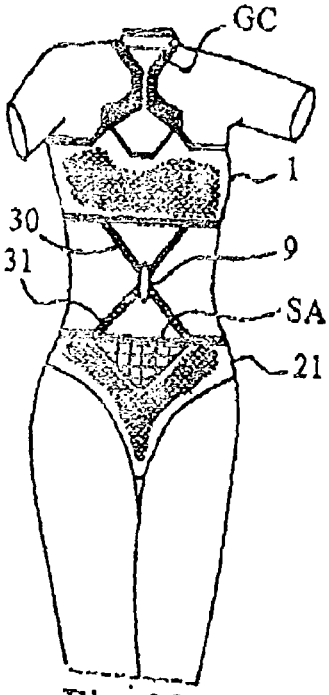
FIGS. 30, 32 and 33 shows different embodiments of compound manufactured items consisting of separate knitwear items 1 and 21 structurally and functionally connected to each other with one or more rings 9.

The following description will be carried out, with descriptive and non-limiting purposes only, with reference to a circular knitting machine for producing tubular knitted items in general comprising at least: a needle bed or rotary cylinder versus fixed cams or vice versa; a complete working feed, provided with one or more yarn feeders which can also be moving; preferably electronic needle selection for controlling the elements involved in the knitting process according to a work cycle and/or a jacquard design; knitting cams which can also be individually adjusted via computer; a device for opening needle latches upon actuation; a fabric pulling or suction system. The machine is also equipped with a dial provided with selectable needles or jacks, beyond the usual yarn suction and cutting device. Advantageously the knitting machine is provided with at least two needle or jack beds for producing double welts, provided inside also with floating or partially woven yarns so as to stiffen the dimensional stability in the direction of the knitted courses, thus preferably obtaining three-dimensional welts with circular section. In particular most of the following description relates to a "full electronic" single-cylinder circular machine, such as for instance Santoni SM8. In the example taken from the prior art shown in FIG. 1, the traditional breast band or brassiere 1 consists of the jersey fabric MJ delimited by the usual upper two-layer elastic band 2 and lower two-layer elastic band 3. The shoulder straps SS and SD are first produced and then undergo a cutting-sewing operation. In a first preferred embodiment the invention is firstly carried out by preparing a work cycle or jacquard design, i.e. direct inputs to needles or jacks or other elements directly or indirectly involved in the knitting process, by means of a graphics workstation or other control and memory devices, i.e. by means of electro-mechanical, magnetic and optical apparatus, or other means suitable to said purpose. During its production, which can indifferently start from the aforesaid band 2 or 3, the manufactured item 1 of FIG. 2 is generally modified according to the present invention both by creating individual holes H, variously placed, and by detaching a suitable number of successive stitches in the direction of the courses, usually less than 360° of the needle cylinder. In the specific case the detachment of the above-mentioned stitches takes places on the arrows F and F1 around the needle cylinder, but for the front portion corresponding to the broader central hole H1 of FIG. 2. In practice the almost complete detachment of the upper band 2, which has just been manufactured, can take place in at least two ways: by means of a special thermo-soluble yarn used in specific areas, which totally or partially melts during the hot fixing stage; or preferably by temporarily cancelling all feeds, by excluding the yarn feeders and by subsequently temporarily stopping the production cycle. Now, according to the jacquard design and to the work cycle, only the needles previously programmed, which are grouped and placed adjacently in the specific case, are selected again and sent to at least a yarn-free ascending cam (not shown) so that they can be completely raised. The maximum raising of these needles results in two important situations: all their latches L automatically open and place themselves over the last stitches B, which are still laid in the needles, such as 1–3 in FIG. 14.

The following descent stage of said needles is shown in FIGS. 18–19–20.

The needle A of FIG. 18 begins its descent and the last stitch B, placed close against the stem of said needle, gets under the latch L and starts to close the latter automatically and progressively. If the needle descent goes on, said latches will be completely closed, FIG. 19, and will work as "bridges" for said stitches B, which are then definitely detached, as in FIG. 20. Simultaneously, also the fabric sinkers PM get back progressively and radially following arrow F, synchronously with the descent movement of the needles A. According to the invention the progressive discharge of said stitches B from the concerned needles preferably takes place after the production of one or more previous knitted courses made of non-run fabric MI, FIG. 2, i.e. textile structures characterised by the simultaneous presence of normal stitches, tuck stitches and welts, said terms being known to people skilled in the art. As a matter of fact, in order to avoid unwanted runs, it is provided for a textile preparation stage according to which the last knitted courses produced before the last knitted course or waste W, FIG. 3, are characterised by knitted structures, also two-layer, mesh or non-run fabric, with variable thicknesses which are electronically controlled via a computer by the corresponding motorized knitting cams (not shown), together with the optional use of suitable yarns, for instance thermo-adhesive yarns, or anyhow melting gradually interlacing with the adjacent stitches. In this operating stage the total discharge of the fabric from the programmed needles causes within the knitted tube a horizontal continuous opening in the direction of the courses, which then foams a fabric hole or semi-ring (2 and GC, in FIG. 3) only partially connected with the manufactured item according to technical and productive contingent variables.

According to the invention, since the manufacturing process should necessarily be re-started, the needles which are now disengaged and temporarily fabric-free are selected and progressively directed onto at least an ascending cam following pre-defined selection sequences such as for instance 1:6 (or 1:3, an operating needles and three excluded needles) and 1:1, so that on the basis of technical-textile features first all needles and/or only half of the disengaged needles, the odd ones afterwards for instance, take up the new yarn again to re-start knitting in at least a feed, for the production of a hem or double welt, or two-layer welt, such as Bi in FIG. 12. At the beginning of the ascent the needles which are still disengaged and with still closed latches L find on their obligatory path a latch-opening device AL which forcedly opens said latches. The described procedure is schematically described in FIG. 17: the latch L is still against the jack of the needle U into which a latch-opening metal tip AL is automatically placed, operating until the latch L is opened and overturned in the direction of arrow F. FIG. 16 is a plan view of a portion of the cylinder CYL rotating in the direction of the arrow F, with the jack of the needle U against which the latch L and the adjacent latch-opening device AL are placed. The jack or hook U of the needle, adhering to the latch L, finds on its obligatory ascending path the latch-opening device L, which has been introduced to this specific purpose.

Once the needle latches have been opened as previously described (in other embodiments the latch is opened by means of a suitable intake of compressed air coming from above, or by means of a thin plate inserted between the jack and the latch), the knitting process starts again. According to the present invention the second knitting cycle re-starts both with a single and with a double welt such as BD in FIGS. 2–3–4 by the fixed selection of alternated needles such as Bi in FIG. 12. In order to obtain different aesthetic and commercial results, the knitting process can also be re-started in a different way, i.e. with a number of needles which has been greatly reduced with respect to normal conditions, the so-called needle discard, so as to produce one or more zones made of thinner, lighter and more transparent fabric with respect to the adjacent one, said zones being generically indicated with SA in FIGS. 24–25–26.

The best results can usually be obtained by excluding for a relatively long period a suitable number of needles since the beginning of the knitting process, though taking suitable precautions, satisfying results can also be obtained in other positions of the manufactured item, provided that the stitches are suitably discharged by the needles which have to be disengaged from the knitting process.

The above-described technique therefore allows to produce almost in every part of the manufactured item the holes generally indicated with H, having different purposes. In FIG. 3, the fabric ring or neck portion GC, only partially connected with the underlying knitted tube 1, is preferably and successively introduced into the central hole H-H1 following arrows F until it takes on the shape and functions of the neck portion GC in FIG. 4.

By suitably coordinating the width of the aforesaid hole H1 with suitable stitch structures of the jersey fabric JO in the central zone CA and around the breast, which is produced with expressly larger fabric MA, said neck portion GC in FIG. 4 also has functions of anatomic support of the breast zone. A variation of the described technique is shown in FIG. 5: in the specific case the double-welt bands, referred to in FIG. 2 with numerals 2 and 3, which were first clearly separated from the knitted tube 1, are then introduced one into the other to obtain original combinations and aesthetic and functional connections which can also apply to other cases beyond the example shown.

As far as FIG. 3 is concerned, according to the invention the zone between the breasts is widely characterised by a plurality of floating yarns FF, placed directly under the opening H, having aesthetic and functional purposes; said floating yarns can also be partially knit, as indicated in FIGS. 10*b* and 10*c*. In the specific case, the width of said floating yarns FF gradually decreases because of the progressive programed introduction of the disengaged needles into the knitting cycle. Generally the presence of the holes H, different in their width and arrangement, has a high relevance in the manifold embodiments of the present invention; for instance, if suitably arranged near the single welt BS of the knitted tube 1 of FIG. 6, they enable the introduction and use of at least a string L with interesting aesthetic and commercial results; indeed, if the various possible embodiments are considered, it is possible to obtain according to the circumstances: a collar, the end of a sleeve or leg, the belt of a pair of pants or trousers, the neck of a bag or rucksack or a technical item. FIG. 7 shows a combination similar to the previous one, which refers, however, to a knitted tube whose end has a double or two-layer welt DB; the two close holes H produced according to the invention enable the subsequent introduction of the string L to the above-described purposes. FIG. 9 shows a dress 1 which has been expressly provided with a series of applications and embodiments falling within the framework of the invention, among which the various strings L and the holes H placed in the central and lower portion of the manufactured item, whereas FIGS. 8 and 8*a* show an enlarged view of the upper portion on the neck, indicated with Bi and C.

In this case the portions of single welt BS and BS1 of the knitted tube TM are alternated with two opposite fabric zones with two layers or double welt DB, preferably produced using only the alternated needles following the patterns of FIGS. 11–12. In practice, the outer edges of FIG. 8*a* will be sewn following the arrows F; as a consequence the half-welts of the central portion Bi, if placed one beside the other, form a kind of complete and finished collar with two opposite layers, such as Bi in FIG. 12.

The drawings shows a detailed view of other embodiments falling within the framework of the present invention. FIG. 21 shows the rear portion of a knitted item 1 characterised by fabric zones 51 whose double welts SD are the same as the welts Bi previously described; said knitted zones 51 are alternated with broad empty zones E produced with the described technique providing for the programmed discharge of stitches in the direction of the courses. In FIG. 22 the analogous horizontal knitted stripes 11 are quite thin with respect to the preceding ones 51.

FIG. 23 shows the front portion of the manufactured item 1, characterised by the central zone of various mesh knitted stitches MO (needle selection 1:1–2:1–2:2 and the like), whose purpose is to foster the expansion of the adjacent breast areas manufactured with larger fabric MA. The manufactured items variously represented in FIGS. 24–25–26 are further characterized by fabric zones with needle discard SA, which are substantially different with respect to the adjacent fabric since they are more transparent and lighter to aesthetic and commercial purposes. In particular, the shoulder straps SS-SD are obtained by partially detaching the front portion of the welt BD, which—if raised following the direction of the arrows F (FIGS. 27–28), takes on the final position DB1 behind the user's neck. The holes indicated with H in the various figures, beyond indicating the needles out or in daring the knitting process, can also have an aesthetic and functional purpose if suitably arranged. FIGS. 28 and 29 show a sectioned and schematic view of a manufactured item 1 generally provided with a front portion but quite open on the back, a so-called "top" with naked shoulders. At present, as is generally known, such textile items are manufactured with several weaving, cutting, sewing operations with corresponding scraps. According to the invention such a knitted item, almost finished and complete, is manufactured directly in the machine and without scraps. In practice, the upper shoulder straps DB1 are obtained by partially detaching the upper two-layer welt DB described above. The knitting process can be taken up again in various ways: with the rolled-up single welts BSA, or with the described method concerning two-layer edges Bi technically shown in FIGS. 11 and 12, and finally with a double fabric manufactured by means of a part of the dial jacks or needles, preferably for about 180°, or another needle bed, using only partially the technique used to manufacture the so-called double welt or elastic band for hosiery items, said terms being known to people skilled in the art.

FIG. 28 shows a sectioned and schematic view of the manufactured item 1, characterised by three different combinations concerning the production of openings on the shoulders and corresponding fabric stripes 20–22–23 having respectively:

the rolled-up single welts BSA;

the two-layer welt Bi;

the double welt DB obtained by means of the jacks or needles or other needle bed.

Among the aims of the present invention there is also the substantial modification of the textile connection of each end of the various fabric stripes 20–22–23 and others such as 11 in FIG. 22, with the knitted tube 1. According to the invention the single stitches are replaced by a plurality of variously floating yarns, such as for instance those shown in table 2, FIGS. 10 to 10*c* included, or such as FFL-FFI-FFT in FIG. 28.

This result can easily be achieved by delaying a suitable number of needles at the beginning and at the end of each course produced after the stitch discharge necessary to obtain the wide openings which constitute an object of the invention, or by temporarily eliminating from the knitting process, for a variable number of courses, groups of needles, with the described technique of needle discard in definite zones.

The invention also relates to the structural stiffening of the horizontal fabric stripe produced by means of the dial needles or jacks (DB FIG. 28 and BD2 FIG. 29), with the additional introduction of one or more variously floating yarns, which can also be of different nature and colour, knitted on their ends only, such as FF within BD2 in FIG. 29, which shows two different ways to obtain the neck portion or shoulder straps of the manufactured item 1: the initial double welt DB is partially separated from the knitted tube and raised at choice from opposite initial positions according to the arrows F-F1, to take on either final configurations DB1. In the aforesaid FIG. 29 the front portion of the manufactured item 1 is characterised among other things by areas of larger fabric MA, anatomically shaped and therefore more comfortable. By the way, the manufactured item 1 can also be produced with two symmetrical wastes such as W-W1 by starting indifferently from each end of the knitted tube. Other embodiments within the framework of the present invention are shown in the drawings. FIGS. 30–31–32 and 33 show some knitwear items assembled, produced and completed according to the teachings of the invention.

Figure 31:
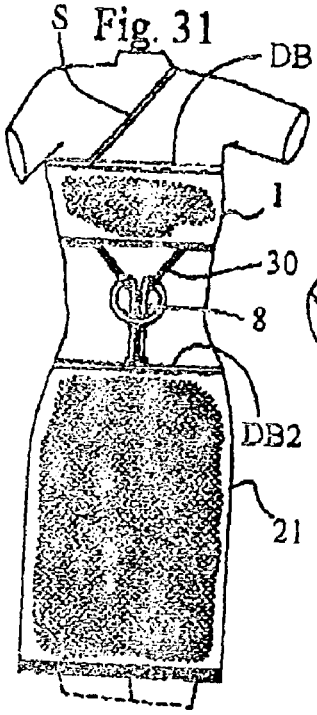
FIG. 31 shows another embodiment of a compound knitted item consisting of two separate knitwear items connected with a fabric connection 8.
Figure 32:
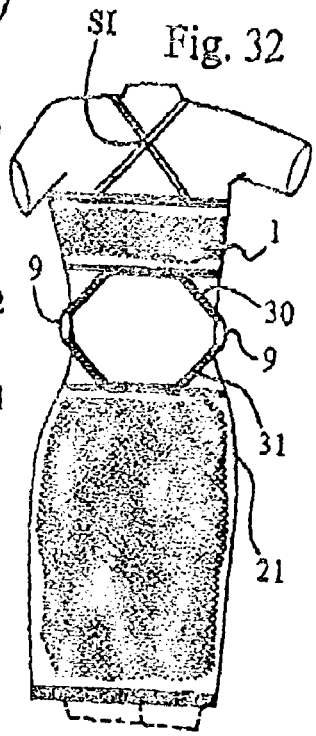

In FIG. 30 the manufactured item 1, characterised by the neck portion GC and by the detached welt 30, is connected by means of a ring 9 (or another similar mean) with the underlying manufactured item 21, i.e. a pant characterised by the single or double welt 31, which can also be elastic, and by a large central zone of thinner fabric with needle discard SA. FIG. 31 shows another manufactured item consisting of two separate items, 1 and 21. The upper portion 1 is a breast band or brassiere which, differently from the example from the prior art of FIG. 1, is provided with the single upper shoulder strap S obtained by partial separation of the upper welt DB, which is technically the same and repeated also on the lower welt 30, within which the fabric ring 8 is connected, said ring being produced by almost complete separation of the upper welt DB2 of the manufactured item 21. The compound manufactured item 1–21 of FIG. 32 is further characterised in that the upper portion is provided with two crossed shoulder straps SI, whereas the connection between the single items 1 and 21 is carried out by means of two rings 9 placed on the hips.

Figure 33:
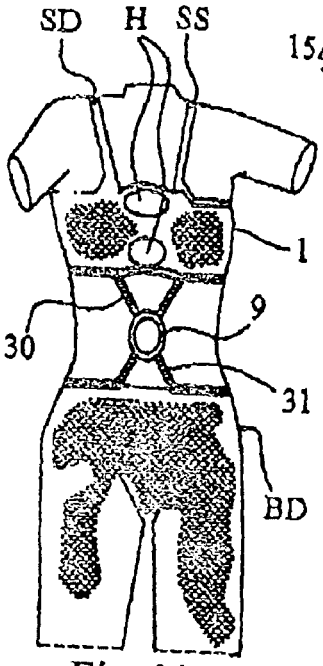
Figure 34:
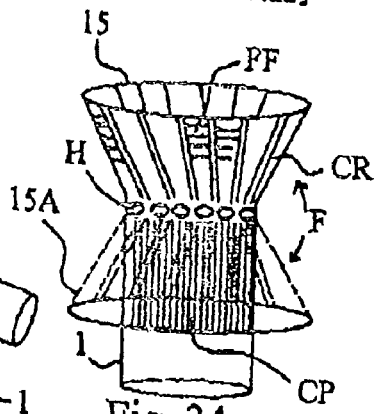
FIG. 34 shows a knitted item 1 made with particular effects of needle discard and floating yarns FF.
Figure 37:
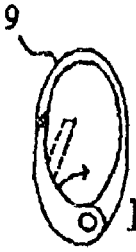
FIG. 37 shows a ring 9 provided with an oscillating lever.
Figure 36:
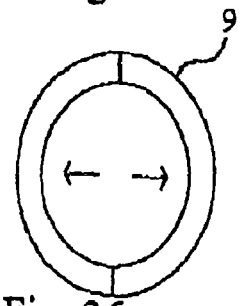
FIG. 36 is an enlarged view of a ring element 9 consisting of two half-rings fitting one into the other.

FIG. 33 shows a different embodiment of the compound manufactured item; the upper portion 1 is provided with single shoulder straps SS and SD and with holes H placed in the breast central zone. Also in this embodiment the aesthetic-functional connection between the single knitwear items 1 and 21 is obtained by partial detachment of the welts 30 and 31, which are then joined by means of the element 9, in an enlarged view in the following FIGS. 36 and 37. In the first case, FIG. 36, said ring consists of two half-rings fitting one into the other, whereas FIG. 37 shows a ring with oscillating lever, a so-called spring ring. As is evident, different technical and textile combinations are possible on the basis of specific economic or fashion situations. As far as the manufacture of items characterized by one or more zones of thinner fabric produced according to the invention is concerned, FIG. 34 shows a detail concerning the manufactured item 1 (which can indifferently be a sleeve, stocking, collar, welt and the like) produced from the beginning 15 with a reduced number of operating needles, which are clearly separated from broad zones of floating yarns FF, which can possible be of different colour, nature and count.

Figure 35:
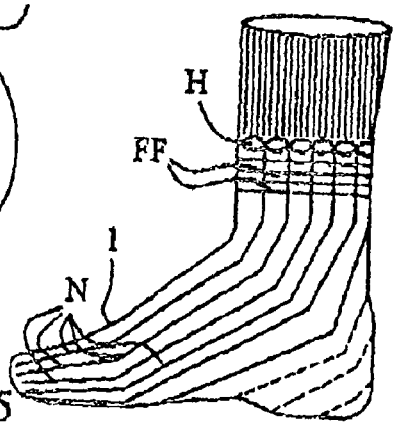
FIG. 35 shows a stocking made with the same technique used for the item of FIG. 34.

The single stitches, which are far wider, are placed so as to form ribs of thin fabric CR and give an initial cup effect 15, which can then be used in an overturned position 15*a*, to obtain further transparent effects on the underlying full-rib fabric CP. H indicates the holes produced by the new needles starting work. The same technique applied to a stocking for another manufactured item) causes the effect shown in FIG. 35; the stocking 1 starts from the toe (or indifferently from the welt), with the needles N at quite a great distance one from the other and joined by floating yarns FF, which can be of different colour, nature and count.

The present invention is further carried out by the embodiments shown in table 5. The manufactured item 1 of FIG. 38 is characterised in that it has 4 wide openings or holes H which form a fabric stripe 50 with two ends provided with floating yarns FF, which are then cut along the direction of F and produces two fabric edges provided with fringes FR.

The edges of the stripe 50 are then joined with the knot K shown in FIG. 38*a*; variations producing diagonal or vertical stripes and knots are obviously possible. In FIG. 38*b* the pants 1 are strongly characterised by the wide front opening H under which several floating yarns FF are placed in decreasing order so as to improve the aesthetic and commercial value of the manufactured item.

The technique concerning the presence and different functions and the use of floating yarns produced according to the invention is proposed again in FIG. 39; the central portion of the manufactured item 1 contains a horizontal opening H followed, according to the production cycle, by a thick plurality of floating yarns FF, produced by the temporary absence of some needles after obtaining the opening H.

The different position of the aforesaid floating yarns produces the original results shown on FIGS. 40 and 40*a*. The production of the manufactured item 1 starts from the neck portion GC or double welt DB; simultaneously an appropriate number of needles within the cylinder is initially excluded from the knitting process so as to produce as an alternative the floating yarns FF: Said neck portion is separated according to the techniques described above, i.e. by the programmed detachment of consecutive needles, and is only partially connected with the knitted tube being worked. The following cutting operation of said floating yarns along the arrow F produces two fabric edges which, preferably knotted as K in FIG. 40*a*, can be used as singular foulard, scarf or other similar decoration provided, in the specific case with fringes FR. The knitwear item 1 of FIG. 41 is characterised by a continuous presence of floating yarns produced in the central zone. The knitted tube 1 is produced by the total and continuous exclusion of some needles on the front portion of the tubular item. Said exclusion results in the plurality of overlapping floating yarns FF. Said floating yarns are then preferably cut in the direction of the arrow F with the subsequent opening of the manufactured item and the production of vertical welts characterised by fringes of different length produced by said cut yarns. Finally, FIGS. 42 and 43 show the stages of production of another manufactured item produced according to the invention: a generic garment or swimsuit 1 provided with an upper portion 1 structurally connected with the lower portion 21 by means of the reduced front portion which reaches the back with the belt P-P1 and is then cut on the back portion. It can also consists only of floating yarns and its two ends P-P1 are preferably knotted on the front portion following the direction of the arrows P and F1 thus forming the knot K. The details of execution can equally vary as far as shape, dimensions and/or arrangement are concerned, and also for the nature of the technical and/or textile materials used, though always falling within the framework of aims of the present patent.

What is claimed is:

1. Method for automatically producing three-dimensional tubular knitwear items, in circular knitting machines provided with at least a cylindrical needlebed (CYL), characterised in that it comprises the steps of:

inactivating and excluding from the knitting process at least a predetermined number of adjacent needles (A) of the needlebed (CYL), chosen in at least a defined knit area of the needlebed (CYL), for a predetermined time interval and producing, with the remaining working needles (A) of the needlebed (CYL) and with the continuous motion of the needlebed (CYL), a first length of tubular knitted fabric (1) having an annular shape and having a plurality of floating yarns (FF) in a zone of the knitted item (1) corresponding to said defined area of the needlebed (CYL), said zone of the knitted item (1) being provided to constitute a zone of the final knitted item (1) characterized by the presence of said floating yarns (FF) having aesthetic and/or functional purposes.

2. Method according to claim 1 characterised in that at least a part of said predetermined number of needles (A) is inactivated automatically and progressively.

3. Method according to claim 1 characterised in that it further comprises, before said step of inactivating and excluding from the knitting process at least a predetermined number of adjacent needles (A), the step of producing a second length of tubular knitted fabric (1), said predetermined number of needles (A) completely releasing and discharging the corresponding loops of the knitted fabric (1) during said step of inactivating and excluding from the knitting process said predetermined number of adjacent needles (A), whereby at least an opening (H) is produced between said second length and said first length of the knitted item (1), in a zone corresponding to said defined knit area.

4. Method according to claim 1 characterised in that it further comprises the steps of reintroducing said predetermined number of needles (A) in the knitting process after said predetermined time interval corresponding to a plurality of stitch courses, by an automatic and programmed resumption of knitting on said predetermined number of needles (A), and producing, after said first length of knitted fabric (1), a third length of tubular knitted fabric (1).

5. Method according to claim 1 characterised in that it further comprises the step of cutting said floating yarns (FF), in a phase subsequent to the knitting process of the knitted item (1), to obtain in said zone of the knitted item an opening (H) with fabric edges provided with fringes of variable length.

6. Method according to claim 3 characterised in that it further comprises the steps of:

reintroducing said predetermined number of needles (A) in the knitting process immediately after said step of inactivating and excluding from the knitting process at least a predetermined number of adjacent needles (A) of the needlebed (CYL), by an automatic and programmed resumption of knitting on said predetermined number of needles (A), and resuming the knitting process with both the excluded needles (A) and the remaining needles (A) and producing a third length of tubular knitted fabric (1), thus providing at least an opening (H) in the knitted item (1) between said second and said third length of knitted fabric (1), in said defined area of the needlebed (CYL) corresponding to the excluded needles (A), with a controlled partial separation of two theoretically consecutive stitch courses.

7. Method according to claim 6 characterised in that the dimension of said defined knit area is determined in order to obtain an opening (H) defining in said item at least a fabric stripe, loop, shoulder strap or brace.

8. Method according to claim 3, further comprising the step of providing said shoulder straps, braces and/or openings (H) with hemmed fabric and with at least a single or double layer welt (BD), said welt being produced with the needles (A) of the cylindrical needlebed (CYL) and by means of a second needlebed or dial.

9. Method according to claim 3, further comprising the step of providing said shoulder straps, braces and/or openings (H) with hemmed fabric and with at least a single or double layer welt (BD), said welt being produced with the needles (A) of the cylindrical needlebed (CYL) by producing inner frills (Bi) with a fixed and prolonged selection of alternated needles (A).

10. Method according to claim 4 characterised in that at least a part of said predetermined number of needles (A) is reintroduced in the knitting process progressively.

11. Method according to claim 1 characterised in that said predetermined number of needles (A) excluded from the knitting process are chosen in at least two defined and separate knit areas of the needlebed (CYL).

12. Method according to claim 1 in which said step of inactivating and excluding from the knitting process at least a predetermined number of adjacent needles (A) of the needlebed (CYL) comprises the steps of interrupting the knitting process with all the needles (A) of the needlebed (CYL) in non-working position and all the yarn-feeders excluded and releasing the loops of the knitted fabric (1) engaged to said predetermined number of excluded needles (A), while the remaining needles (A) of the needlebed (CYL) retain their loops of knitted fabric (1).

13. Method according to claim 1, comprising providing automatically said items with one or more shoulder straps, loops, braces and/or holes (H), eyelets and/or floating yarns (FF), operating with the continuous motion of the needle cylinder and by the temporary and gradual interruption of the knitting process for a group of preferably adjacent needles (A), in definite fabric areas, less than 360°, followed by the automatic and gradual re-start of the knitting process, preferably with the same needles (A) or in the same definite fabric areas, after the intervention of mechanical or pneumatic elements working as latch-opening devices (AL) for the controlled separation of two knitted courses which are theoretically consecutive and also partially overlapping; said courses being characterised in that one of them represents the last course of knitted fabric (1) and the other one the first course produced after said interruption, said openings (1) and/or loops being obtained without cutting and sewing operations.

14. Method according to claim 13 for producing tubular items which can also be shaped or fitted, provided with one or more holes or openings (H) which can also be very broad, automatically produced by the appropriate selection, presence and absence of the elements directly or indirectly involved in the knitting process, such as jacks, needles (A), under-needles (A) and fabric sinkers (PM).

15. Method according to claim 1 characterised in that it comprises the steps of providing automatically said tubular items with one or more fabric rings, loops or half-rings at least partially connected with the manufactured item (1), and introducing or connecting at least partially said fabric rings in at least a hole or other opening (H) of the manufactured item (1).

16. Method according to claim 1 characterised in that it comprises the steps of providing automatically said tubular items with one or more fabric rings, loops or half-rings at least partially connected with the manufactured item (1), and introducing or connecting at least partially said fabric rings in at least a hole or other opening (H) of another knitted article or textile manufactured item (21).

17. Method according to claim 1 comprising producing in said tubular items an anatomically shaped portion and a substantially naked portion having wide apertures alternated to suitable fabric swipes, preferably provided with single or double hems or welts (DB).

18. Method according to claim 7 characterised in that at least a portion of said fabric stripes (11,51) is produced with a plurality of floating yarns (FF).

19. Method according to claim 7 further comprising the steps of cutting said fabric stripes or loops and preferably subsequently knotting said stripes.

20. Method according to claim 1 further comprising the step of producing automatically in said items (1) at least a zone (SA) of lighter and more transparent fabric, by knitting the item (1) with a substantially reduced number of needles (A).

21. Method according to claim 1 for producing compound knitted items, further comprising the step of connecting structurally and functionally at least two knitted items (1, 21) one to the other, by means of connection means such as stripes, strings or half-rings.

22. Method according to claim 1 characterised in that the knitting process of the excluded needles (A) is preceded by the intervention of latch-opening devices (AL) and starts again only with selected needles (A) always following an alternated order, in at least a feed provided with yarn.

23. Method according to claim 3 characterised in that the discharge of the stitches from part of the needles (A) is anticipated by one or more knitted courses, which can also consist of tuck stitches and/or welts, preferably with the introduction of at least a additional yarn, which can also be elastomeric and/or thermo-adhesive.

24. Method according to claim 3, characterised in that the discharge of the stitches from part of the needles (A) takes places by totally lowering said needles (A) without the new yarn, under the pulling-down plane of the sinkers (PM), synchronously with the radial removal of the latter.

* * * * *